US005199480A

United States Patent [19]

Schultz et al.

[11] Patent Number: 5,199,480

[45] Date of Patent: Apr. 6, 1993

[54] SEALED SHOT SLEEVE FOR VACUUM DIE CASTING

[75] Inventors: Thornton E. Schultz, Kenosha; LaVerne D. Smith, Pewaukee; Russell J. VanRens, Milwaukee, all of Wis.

[73] Assignee: Outboard Marine Corporation, Waukegan, Ill.

[21] Appl. No.: 874,740

[22] Filed: Apr. 27, 1992

[51] Int. Cl.[5] ..... B22D 17/14; B22D 17/20

[52] U.S. Cl. ..... 164/65; 164/113; 164/253; 164/305; 164/312

[58] Field of Search ..... 164/61, 63, 65, 113, 164/253, 254, 305, 312

[56] References Cited

U.S. PATENT DOCUMENTS

| | | | |
|---|---|---|---|
| 2,785,448 | 3/1957 | Hodler . | |
| 2,799,066 | 7/1957 | Federman et al. . | |
| 2,867,869 | 1/1959 | Hodler . | |
| 3,008,202 | 11/1961 | Bauer . | |
| 3,085,302 | 4/1963 | Federman . | |
| 3,106,755 | 10/1963 | Moore . | |
| 3,139,655 | 7/1964 | Cooper et al. . | |
| 4,146,081 | 3/1979 | Reis | 164/61 X |
| 4,154,286 | 5/1979 | Glazunov et al. . | |
| 4,240,497 | 12/1980 | Glazunov et al. . | |
| 4,854,370 | 8/1989 | Nakamura | 164/312 X |

FOREIGN PATENT DOCUMENTS

| | | | |
|---|---|---|---|
| 4002263 | 8/1991 | Fed. Rep. of Germany | 164/312 |
| 59-144566 | 8/1984 | Japan | 164/305 |
| 62-207554 | 9/1987 | Japan | 164/253 |
| 1-313172 | 12/1989 | Japan | 164/253 |
| 461796 | 8/1975 | U.S.S.R. | 164/312 |
| 914508 | 1/1963 | United Kingdom . | |

*Primary Examiner*—J. Reed Batten, Jr.
*Attorney, Agent, or Firm*—Welsh & Katz, Ltd.

[57] ABSTRACT

The apparatus has a generally cylindrically shaped rotating collar for sealing the chamber after casting material has been poured into it. The apparatus has a slidable plunger mechanism with an enlarged tip for forcing casting material through a shot sleeve toward the die. A flat annular collar retainer plate is located at right end of the collar. A sleeve seal tube is attached to the collar retainer plate adapted to receive the plunger tip. A seal housing is carried by and is slidable on the plunger stem, has an enlarged left end portion in which a sleeve seal is located so that when the plunger mechanism is moved to the left, the plunger tip enters the chamber and the seal housing and plunger stem move to the left until the seal engages the seal tube during leftward movement of the plunger. Further movement of the plunger stem results in the stem sliding relative to the seal housing while the plunger tip forces material in the chamber toward the die cavity. A vacuum is produced behind the plunger tip during movement which prevents premature flow of casting material into the die cavity.

33 Claims, 2 Drawing Sheets

SEALED SHOT SLEEVE FOR VACUUM DIE CASTING

The present invention generally relates to die casting apparatus, and more particularly relates to a sealed shot sleeve apparatus for vacuum die casting.

It is generally known that metal die casting operations produce improved quality castings if the die cavity in which the casting is formed is evacuated of air prior to injection of the casting material into the cavity. While there have been many different designs for providing a vacuum in the die cavity, most of the designs have a valve which communicates the die cavity with a source of vacuum and this valve is opened to evacuate the cavity immediately prior to placing a shot of molten metal into the cavity and is closed before the metal reaches the cavity. The metal is placed into a shot sleeve apparatus which has a plunger that pushes the metal into the cavity, but the metal must first travel through a runner or channel that extends from the shot sleeve apparatus to the die cavity and which may be some significant distance. It is preferred that the shot sleeve apparatus move at a slower rate while the metal is being pushed through the channel, but when it is placed into the cavity itself, it is done at a relatively fast rate.

It has also been found that fewer imperfections, in terms of surface spalling, smoothness, the presence of bubbles and the like, occur if the metal is injected into the die cavity solely as a result of the movement of the plunger through the sleeve, and that no premature flow of the metal from the channel into the die cavity occurs from any other influence, such as by the vacuum force in the cavity pulling the metal into the cavity.

If the plunger is effectively sealed so that no air can pass from behind it, then the vacuum in the die cavity will not be effective to pull casting material from the channel into the die before the plunger actually pushes it into the die cavity. While prior art arrangements have attempted to prevent this premature injection, they often are ineffective or tend to become obstructed which requires maintenance to free them.

Accordingly, it is a primary object of the present invention to provide an improved shot sleeve apparatus for vacuum die casting which offers superior operating characteristics in that it effectively seals the plunger and prevents the casting material from being pulled into the die cavity before the plunger pushes the shot into the cavity.

Another object of the present invention is to provide such an improved shot sleeve apparatus which effectively seals the plunger, and yet is extremely reliable in its operation and requires low maintenance.

Still another object of the present invention lies in the provision of producing a vacuum behind the plunger during its forward stroke which moves the casting material into the channel and thereafter the die cavity. The vacuum induced rearwardly of the plunger necessarily eliminates the supply of air that could otherwise be pulled past the plunger in the sleeve which often tends to result in premature injection of the casting material into the die cavity.

Yet another object of the present invention lies in the provision of an improved shot sleeve apparatus that has a rotating collar which permits a shot of casting material to be poured into the shot sleeve apparatus and by a rotation of the collar, effectively seals the sleeve.

A more detailed object of the present invention is to provide a shot sleeve apparatus having a reciprocating plunger, wherein the plunger has a seal housing that fits around it so that during initial movement of the plunger, the seal is brought into sealing position with the end structure of the shot sleeve apparatus, and continued movement produces a vacuum rearwardly of the plunger.

Still another object of the present invention is to provide a shot sleeve apparatus which is effective to provide a vacuum rearwardly of the plunger in a unique manner which does not require communication to a source of vacuum. More particularly, it is an object of the present invention to provide an improved shot sleeve apparatus which has a seal housing that is carried by the plunger stem and which engages the sleeve during movement of the plunger and wherein further movement is effective to induce a vacuum in the area behind the plunger.

Other objects and advantages will become apparent upon reading the following detailed description, while referring to the attached drawings, in which.

DETAILED DESCRIPTION

Broadly stated, the present invention is directed to a shot sleeve apparatus that is used in a vacuum die casting operation. The shot sleeve apparatus is adapted to receive a shot of molten casting material and then to force the material into the die cavity of a die casting assembly.

Figure 1:
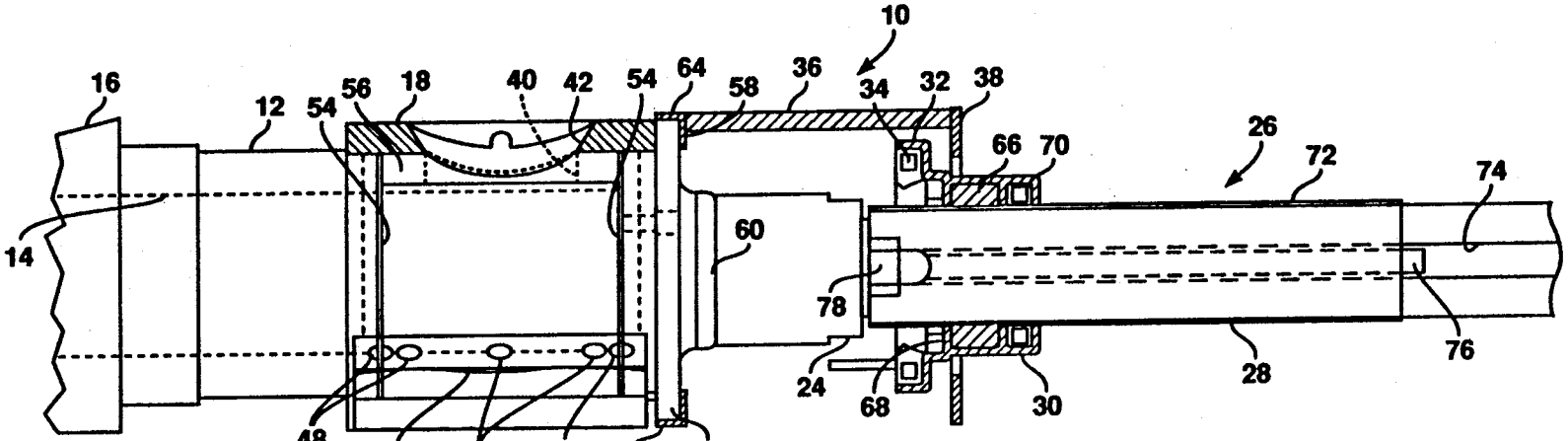
FIG. 1 is a side elevation, partially in section of the shot sleeve apparatus embodying the present invention and is shown in the rest or retracted position.
Figure 2:
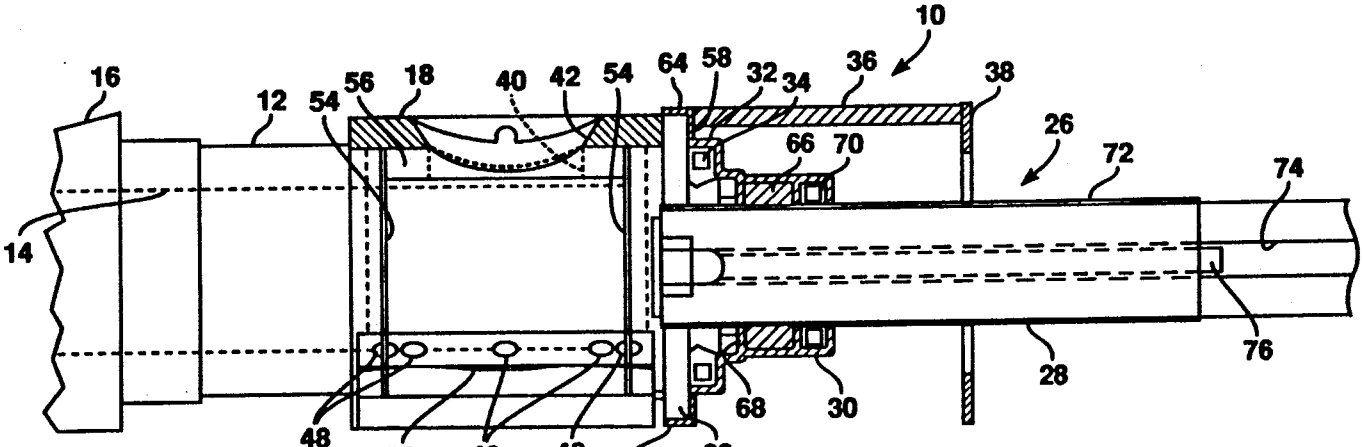
FIG. 2 is another side elevation of the apparatus shown in FIG. 1, but is shown with the plunger partially moved to the left as occurs in a die casting operation.

Turning now to the drawings, the shot sleeve apparatus, indicated generally at 10 in FIG. 1, has a shot sleeve 12 that comprises a cylindrical portion that has an internal chamber 14 that extends to the left into the die body 16 and the chamber 14 communicates with a channel or runner that extends to the die cavity where the casting is formed. The sleeve 12 has a reduced outer diameter portion **12*a* that extends to the right of the portion 12 over which portion 12*a* a generally cylindrically shaped rotating collar 18 is located. The collar 18 has a flat annular collar retainer plate 20 at the right end thereof. A sleeve seal tube 22 is attached to the collar retainer plate 20 and the tube 22 and the plate 20 each have an opening substantially the same size as the internal diameter of the chamber 14 adapted to receive the tip 24 of a plunger mechanism, indicated generally at 26, with the plunger mechanism 26 having a plunger stem 28 that is attached to the plunger tip 24**.

A seal housing 30 is carried by the plunger stem and is movable on it. The seal housing 30 has an enlarged left end portion 32 in which a sleeve seal 34 is located so that when the plunger mechanism is moved to the left, the plunger tip enters the chamber 14 and the seal housing and plunger stem move to the left until the seal 34 engages the seal tube 22 during leftward movement of the plunger. Further movement of the plunger stem results in the stem sliding relative to the seal housing while the plunger tip forces material in the chamber toward the die cavity.

A seal housing locator structure 36 is attached to the collar retainer 20 and after the casting material has been injected into the cavity and the plunger mechanism 26 retracted, the right end flange 38 of the seal housing locator is positioned to engage the right side of the enlarged end 32 of the seal housing and stop the same so that upon further movement of the plunger mechanism, the seal housing will be slid along the plunger stem to return it to its initial position as shown in FIG. 1.

With this broad general description of the apparatus, it should be understood that one of the primary advantages of the present invention lies in its ability to prevent air from leaking past the sides of the plunger tip when air is evacuated from the die cavity in a vacuum die casting process. As previously stated, a vacuum is often applied to the cavity of the die body during the casting process for the purpose of improving the quality of the casting and the evacuation of air from the cavity often reducing porosity in the casting. To improve the ability to draw a vacuum and prevent the vacuum from drawing metal into the die by pulling air around the plunger tip, the gap between the plunger stem and the sleeve must be sealed and the hole in which the metal is initially poured into the sleeve must also be sealed.

There are two major functional parts of the apparatus 10. The first is the seal housing 30 and the second is the rotating collar 18. The apparatus functions by sealing the right side of the plunger tip from the pour hole in the sleeve and from the right or back side of the shot sleeve as the plunger tip 24 travels through the shot sleeve 12. The plunger mechanism 26 carries the seal housing 30 to the back end or right portion of the sleeve so that the sleeve seal 34 engages the seal tube 22 and seals off the back of the sleeve.

It should be understood that the sleeve has a pour hole 40 and the rotating collar also has a conical hole 42 therein, which when the holes 40 and 42 are aligned, enables a shot of molten casting material to be poured into the chamber 14 of the sleeve. During movement of the plunger mechanism 26 and after the sleeve seal 34 has engaged the sealed tube 22, the collar is rotated so that the holes 40 and 42 are not aligned, which thereby seals the pour hole.

When both of these events have occurred, the portion of the chamber 14 behind the plunger tip is a sealed chamber and upon further leftward movement of the plunger mechanism 26, this chamber increases in volume because of the smaller diameter of the plunger stem 28 relative to the diameter of the plunger tip 24 and a vacuum is created behind the tip, which effectively eliminates air flow around the tip, i.e., between the tip and the inside surface of the chamber 14. The increase in the size of the chamber after it has been sealed and through the remainder of the stroke is within the range of 15 to 20 times, so that a vacuum is created behind the plunger tip. Because of the existence of this vacuum, virtually no air is present that could be leaked between the plunger tip 24 and the inside of the chamber 14 that could tend to force the casting material into the die cavity prematurely.

Figure 3:
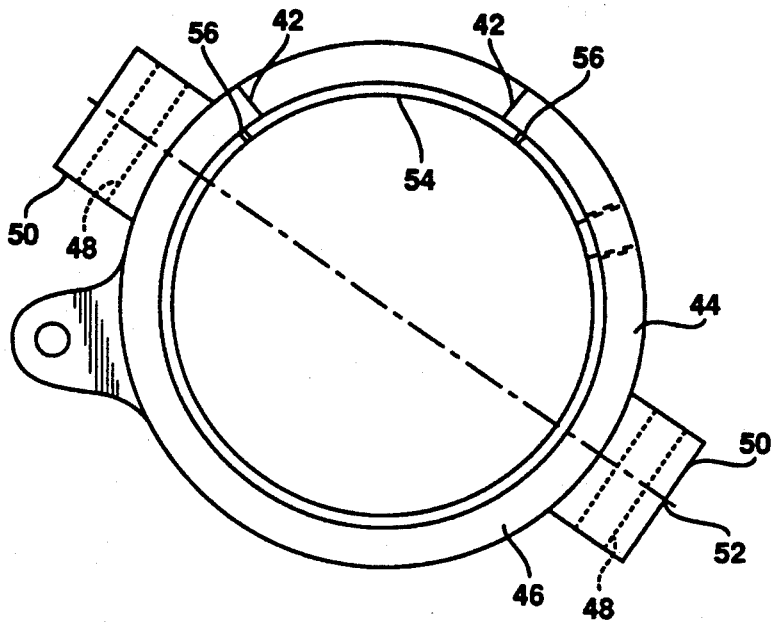
FIG. 3 is an end view of the rotating collar portion of the apparatus shown in FIGS. 1 and 2.
Figure 4:
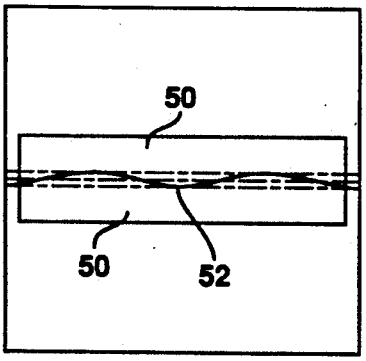
FIG. 4 is a bottom view of the rotating collar shown in FIG. 3 and particularly illustrating the split line of the two components of the rotating collar; and, FIG. 5 is a cross section of a portion of the rotating collar and plunger and illustrating a vane seal used in the preferred embodiment of the present invention.
Figure 5:
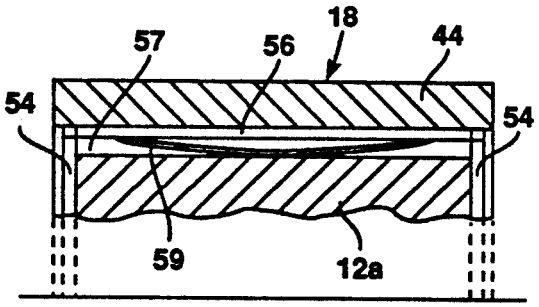

With respect to the construction of the rotating collar 18, and referring to FIGS. 1, 3 and 4, it is shown in FIGS. 3 and 4 to be generally cylindrical in shape and comprised of two sections 44 and 46, with the section 44 having the pour hole 42 therein. The components are attached to on another by suitable bolts (not shown), but which are placed in apertures 48 located in outward flanges 50 that are attached to the respective components 44 and 46. The two components are separable along a split line indicated at 52, which is shown to be curved in FIG. 4 and this is done so that there is not a singular edge that could engage a surface of the sleeve and prevent it from being rotated to seal the chamber 14. As shown in FIGS. 1 and 3, ring seals 54 are located at opposite ends of the collar 18 and vane seals 56 (see FIGS. 3 and 5) are positioned on opposite sides of the pour hole 42 to provide sealing capability when the collar is rotated so that the pour holes 40 and 42 are not aligned. The ring seals 54 are of one piece construction as shown in FIG. 3, and have a split preferably located at the bottom thereof away from the pour hole. The split is preferably only a few thousandths of an inch to minimize leakage. With respect to the vane seals 56, they are retained in slots 57 located in the sleeve portion 12*a* and a leaf spring 59 is provided in the slot which biases the vane seals outwardly to contact the inside of the collar 18 into sealing engagement. It should be appreciated that the bottom surface of the vane seal is still located within the slot 57 to thereby retain the same during rotation of the collar 18 relative to the sleeve portion 12*a*.

The collar retainer 20 is preferably attached to the right end of the sleeve by suitable bolts such as that diagrammatically illustrated at 58 and the rotating collar will rotate relative to this collar retainer. The retainer also provides a mounting surface for the sleeve seal tube 22 which is shown to be generally cylindrical in shape and has an outside bevel which provides a surface for receiving the sleeve seal 34 in sealing engagement. The seal housing locator 36 has an axially directed flange 62 which fits around the outside of the retainer 20 and is connected to it by bolts (not shown) located in a number of apertures 64.

With respect to the seal housing 30, it has an annular bearing 66 that slides on the outer surface of the plunger stem 28, and is preferably made of TEFLON, or some material that facilitates easy sliding movement of the sleeve seal on the plunger stem 28. The seal housing 30 has a radial directed annular flange 68 that is positioned on the left side of the bearing 66 and it provides protection for the bearing from casting material that may be deposited on the plunger stem during casting operations. The flange 68 scrapes the surface of the stem 28 during sliding movement of the housing 30. The housing 30 also has an annular stem seal 70 located at the right end thereof to prevent air from leaking between the bearing and the plunger stem 28 during operation.

The plunger stem 28 has an outer sleeve 72 preferably made of stainless steel that is attached to it. The stem also preferably has at least two axially directed channels 74 in the surface thereof, in which conduits 76 are located and which extend from a supply of lubricating fluid to the left end of the plunger stem. The sleeve 72 has a cutout portion 78 at the left end of each channel 74, and a nozzle (not shown) is attached to the end of each conduit 76 for spraying the lubricant toward the plunger tip during operation. The sleeve 72 is preferably adhesively attached to the plunger stem 28 with silicone rubber or the like, and the silicone rubber is injected into the channels 74 and around the conduits 76 to as to seal the channels so that air cannot enter the portion of the chamber 14 in which the plunger stem is located during operation.

From the foregoing description, it should be understood that an improved shot sleeve apparatus has been shown and described that has many desirable attributes and advantages. The apparatus is reliable in operation, and effectively seals the shot sleeve so that air will not leak into the chamber 14 and cause premature flow of the casting material from the runner into the die cavity. The apparatus is not susceptible to easy fouling and provides superior performance with minimal maintenance.

While various embodiments of the present invention have been shown and described, it should be understood that various alternatives, substitutions and equivalents can be used, and the present invention should only be limited by the claims and equivalents thereof.

Various features of the present invention are set forth in the following claims.

What is claimed is:

1. Apparatus for injecting a shot of fluid casting material into a die cavity during a vacuum die casting operation, the apparatus being adapted to cooperate with a power source and being in communication with a runner that extends to the die cavity in which a die casting is formed, said apparatus comprising:

a sleeve means having an outlet at a first end thereof that is in communication with the runner and having an elongated cylindrical bore adapted to receive at least a portion of a plunger means which drives the material into the runner and the die cavity;

a reciprocating plunger means adapted to be moved between a retracted position and an extended position along a path, said plunger means having a plunger stem portion and a plunger tip portion, said plunger tip portion having an outer diameter approximately the same size as said cylindrical bore;

said sleeve means having a generally cylindrical sleeve member with said cylindrical bore, and a generally hollow cylindrical outer collar means that is rotatable about said sleeve member, said sleeve member and said collar means each having a pour aperture through which casting material may be poured, said collar means being rotatable to generally seal the sides of the bore when the respective pour apertures are not aligned;

said sleeve means having a collar retaining member located at the end opposite said first end, said collar retaining member having an axially oriented annular surface facing away from said collar means, said annular surface being of a diameter that is larger than said plunger tip portion;

said plunger means having a sealing means that is slidably carried thereby, said sealing means being adapted to engage said annular surface after initial movement of said plunger means from said retracted position to generally seal said end of said bore opposite said first end.

2. Apparatus as defined in claim 1 wherein said collar means comprises two mating components so that said collar means can be separated, and means for connecting said components to one another.

3. Apparatus as defined in claim 2 wherein said components have mating surfaces located generally on opposite sides of said collar means, said surfaces being generally parallel to the axial direction of said collar means, said surfaces being curved relative to the axial direction so as to not present a generally constant edge along the periphery that could interfere with the rotation of said collar means relative to said sleeve member.

4. Apparatus as defined in claim 3 wherein said components each have radial extensions with apertures therein, said extensions being located adjacent each mating surface, said connecting means comprising bolt means that are adapted to contact adjacent extensions and hold the components together.

5. Apparatus as defined in claim 1 wherein said collar means includes an outwardly extending lever adapted to be connected to a mechanism for rotating the same.

6. Apparatus as defined in claim 1 wherein said collar means includes a generally funnel shaped depression around said pour aperture, said pour aperture being located in the top of the collar means when said collar means is positioned whereby the pour aperture is generally aligned with the pour aperture of said sleeve member.

7. Apparatus as defined in claim 1 wherein said collar retaining member comprises an annulus that is attached to said sleeve means, said annulus having an inside diameter larger than the diameter of said plunger tip portion, said annulus having an integrally formed annular portion extending away from said sleeve means, said annulus providing said annular surface.

8. Apparatus as defined in claim 1 wherein said sealing means is adapted to be slidable along and relative to said plunger stem portion.

9. Apparatus as defined in claim 8 wherein said sealing means comprises a cylindrical housing having an enlarged cup shaped end portion facing said annular portion of said collar retaining member and including an annular sealing member located in said cup shaped end portion, said annular sealing member being adapted to contact said annular portion of said collar retaining member in substantial sealing engagement when said plunger means is moved toward said extended position.

10. Apparatus as defined in claim 9 wherein said cylindrical housing includes a bearing means located therewithin, said bearing means being constructed to contact the outer surface of said plunger stem portion, said cylindrical housing also having a stem sealing means located on the end opposite said cup shaped end portion, said housing also having an annular scraper means located between said bearing means and said cup shaped end portion, said annular scraper means being adapted to remove debris from said plunger stem portion as said sealing means is moved along the same and thereby protect said bearing means from damage.

11. Apparatus as defined in claim 10 wherein said annular scraper means comprises a radially inwardly directed extension of said cylindrical housing.

12. Apparatus as defined in claim 1 further including means for injecting lubricant onto said plunger tip portion, said means for injecting lubricant being contained within said plunger stem portion.

13. Apparatus as defined in claim 12 wherein said plunger stem portion has at least one axially oriented recess in the outer surface thereof, and has a cylindrically shaped outer sleeve covering the same, said apparatus further including means for injecting includes conduit means extending along the plunger stem portion in said axially oriented recesses beneath said outer sleeve.

14. Apparatus as defined in claim 13 wherein said sleeve is stainless steel and is adhesively secured to said plunger stem portion.

15. Apparatus for injecting a shot of fluid casting material into a die cavity during a vacuum die casting operation, the apparatus being adapted to cooperate with a power source and being in communication with a runner that extends to the die cavity in which a die casting is formed, said apparatus comprising:

a sleeve member having an elongated cylindrical chamber adapted to receive at least a portion of a plunger means and having an outlet at a first end thereof that is in communication with the runner;

a reciprocating plunger means adapted to be moved between a retracted position and an extended position along a path, said plunger means having a plunger stem portion and a plunger tip portion, said plunger tip portion having an outer diameter approximately the same size as said cylindrical chamber;

a generally hollow cylindrical outer collar that is rotatable about said sleeve member, said sleeve member and said collar each having a pour aperture through which casting material may be poured, said collar being rotatable relative to said sleeve member to generally seal the sides of the chamber when the pour apertures of said sleeve member and said collar are not in communication with one another;

a collar retaining member attached to said sleeve member at the end opposite said first end, said collar retaining member being adapted to contact said collar and retain the same in its axial direction while permitting rotation thereof, said collar retaining member having an axially oriented annular surface facing away from said collar, said annular surface being of a diameter that is larger than said plunger tip portion;

a sealing means that is slidably carried by said plunger means, said sealing means being adapted to engage said annular surface after initial movement of said plunger means from said retracted position to generally seal said end of said chamber opposite said first end.

16. Apparatus as defined in claim 15 wherein said collar comprises two mating components so that said collar can be separated, and means for connecting said components to one another.

17. Apparatus as defined in claim 16 wherein said components have mating surfaces located generally on opposite sides of said collar, said surfaces being generally parallel to the axial direction of said collar, said surfaces being curved relative to the axial direction so as to not present a generally constant edge along the periphery that could interfere with the rotation of said collar relative to said sleeve member.

18. Apparatus as defined in claim 17 wherein said components each have radial extensions with apertures therein, said extensions being located adjacent each mating surface, said connecting means comprising bolt means that are adapted to contact adjacent extensions and hold the components together.

19. Apparatus as defined in claim 15 wherein said collar includes an outwardly extending lever adapted to be connected to a mechanism for rotating the same.

20. Apparatus as defined in claim 15 wherein said collar includes a generally funnel shaped depression around said pour aperture, said pour aperture being located in the top of the collar when said collar is positioned whereby the pour aperture is generally aligned with the pour aperture of said sleeve member.

21. Apparatus as defined in claim 15 wherein said collar retaining member comprises an annulus that is attached to said sleeve member, said annulus having an inside diameter larger than the diameter of said plunger tip portion, said annulus having an integrally formed annular portion extending away from said sleeve member, said annulus providing said annular surface.

22. Apparatus as defined in claim 15 wherein said sealing means is adapted to be slidable along and relative to said plunger stem portion.

23. Apparatus as defined in claim 22 wherein said sealing means comprises a cylindrical housing having an enlarged cup shaped end portion facing said annular portion of said collar retaining member and including an annular sealing member located in said cup shaped end portion, said annular sealing member being adapted to contact said annular portion of said collar retaining member in substantial sealing engagement when said plunger means is moved toward said extended position.

24. Apparatus as defined in claim 23 wherein said cylindrical housing includes a bearing means located therewithin, said bearing means being constructed to contact the outer surface of said plunger stem portion, said cylindrical housing also having a stem sealing means located on the end opposite said cup shaped end portion, said housing also having an annular scraper means located between said bearing means and said cup shaped end portion, said annular scraper means being adapted to remove debris from said plunger stem portion as said sealing means is moved along the same and thereby protect said bearing means from damage.

25. Apparatus as defined in claim 24 wherein said annular scraper means comprises a radially inwardly directed extension of said cylindrical housing.

26. Apparatus as defined in claim 15 further including means for injecting lubricant onto said plunger tip portion, said means for injecting lubricant being contained within said plunger stem portion.

27. Apparatus as defined in claim 26 wherein said plunger stem portion has at least one axially oriented recess in the outer surface thereof, and has a cylindrically shaped outer sleeve covering the same, said apparatus further including means for injecting includes conduit means extending along the plunger stem portion in said axially oriented recesses beneath said outer sleeve.

28. Apparatus as defined in claim 27 wherein said sleeve is stainless steel and is adhesively secured to said plunger stem portion.

29. A method of sealing an apparatus for injecting a shot of fluid casting material into a die cavity during a vacuum die casting operation, the apparatus being of the type that is adapted to cooperate with a power source and is in communication with a runner that extends to the die cavity in which a die casting is formed, the apparatus having a sleeve member with an elongated cylindrical chamber adapted to receive at least a portion of a plunger means and having an outlet at a first end thereof that is in communication with the runner, a plunger means that is moveable between a retracted position and an extended position along a path, the plunger means having a plunger stem portion and a plunger tip portion, the plunger tip portion having an outer diameter approximately the same size as said cylindrical chamber and larger than the diameter of the plunger stem portion, a sealing means that is slidably carried by the plunger means, the sealing means being adapted to engage the annular surface after initial movement of the plunger means from the retracted position to generally seal the end of the chamber opposite the first end, said method comprising the steps of:

pouring casting material into the chamber;

sealing the sides of the chamber;

moving the plunger means from the retracted position toward the extended position, the initial movement causing the plunger tip portion to enter the chamber and move the casting material into the runner and bring the sealing means into contact with the annular surface to seal the opposite end of the chamber, continued movement of the plunger means creating an enlarging volume in said chamber between the plunger tip portion and the sealing means resulting from the smaller diameter plunger stem portion, thereby creating a vacuum in the chamber which substantially eliminates any air flow between the plunger tip portion and the chamber, which air tends to prematurely draw the casting material into the die cavity.

30. A method as defined in claim 29 wherein the apparatus is of the type which includes a generally hollow cylindrical outer collar that is rotatable about the sleeve member, the sleeve member and the collar each having a pour aperture through which casting material may be poured, the collar being rotatable relative to the sleeve member to generally seal the sides of the chamber when the pour apertures of the sleeve member and the collar are not in communication with one another, a collar retaining member attached to the sleeve member at the end opposite the first end, the collar retaining member being adapted to contact the collar and retain the same in its axial direction while permitting rotation thereof, the collar retaining member having an axially oriented annular surface facing away from the collar, the annular surface being of a diameter that is larger than the plunger means, wherein the step of pouring further comprises positioning the collar so that the pour aperture thereof is in communication with the pour aperture of the sleeve member and thereafter pouring the casting material into the chamber.

31. A method as defined in claim 30 wherein said sealing step further comprises rotating the collar so that the pour aperture of the collar is not in communication with the pour aperture of the sleeve member to thereby seal the sides of the chamber.

32. A method of sealing an apparatus for injecting a shot of fluid casting material into a die cavity during a vacuum die casting operation, the apparatus being of the type that is adapted to cooperate with a power source and is in communication with a runner that extends to the die cavity in which a die casting is formed, the apparatus having a sleeve member with an elongated cylindrical chamber adapted to receive at least a portion of a plunger means and having an outlet at a first end thereof that is in communication with the runner, a reciprocating plunger means that is moveable between a retracted position and an extended position along a path, the plunger means having a plunger stem portion and a plunger tip portion, the plunger tip portion having an outer diameter approximately the same size as said cylindrical chamber and larger than the diameter of the plunger stem portion, a generally hollow cylindrical outer collar that is rotatable about the sleeve member, the sleeve member and the collar each having a pour aperture through which casting material may be poured, the collar being rotatable relative to the sleeve member to generally seal the sides of the chamber when the pour apertures of the sleeve member and the collar are not in communication with one another, a collar retaining member attached to the sleeve member at the end opposite the first end, the collar retaining member being adapted to contact the collar and retain the same in its axial direction while permitting rotation thereof, the collar retaining member having an axially oriented annular surface facing away from the collar, the annular surface being of a diameter that is larger than the plunger means, a sealing means that is slidably carried by the plunger means, the sealing means being adapted to engage the annular surface after initial movement of the plunger means from the retracted position to generally seal the end of the chamber opposite the first end, said method comprising the steps of:

positioning the collar so that the pour aperture thereof is in communication with the pour aperture of the sleeve and pouring casting material into the chamber;

rotating the collar so that the pour aperture of the collar is not in communication with the pour aperture of the sleeve member to thereby seal the sides of the chamber;

moving the plunger means from the retracted position toward the extended position, the initial movement causing the plunger tip portion to enter the chamber and move the casting material into the runner and bring the sealing means into contact with the annular surface to seal the opposite end of the chamber, continued movement of the plunger means creating an enlarging volume in said chamber between the plunger tip portion and the sealing means resulting from the smaller diameter plunger stem portion, thereby creating a vacuum which substantially eliminates any air flow between the plunger tip portion and the chamber.

33. A method as defined in claim 32 wherein the step of moving the plunger means after the sealing means is in contact with the annular, surface results in an expansion of volume by a factor within the range of 15 to 20.

* * * * *